US007763848B2

(12) United States Patent
Staats et al.

(10) Patent No.: US 7,763,848 B2
(45) Date of Patent: Jul. 27, 2010

(54) APPARATUS AND METHOD FOR CONTROLLING AN ELECTROSTATICALLY INDUCED LIQUID SPRAY

(75) Inventors: Sau Lan Tang Staats, Hockessin, DE (US); Arthur J. Fogiel, Jr., Bear, DE (US)

(73) Assignee: Phoenix S&T, Inc., Chester, PA (US)

( * ) Notice: Subject to any disclaimer, the term of this patent is extended or adjusted under 35 U.S.C. 154(b) by 332 days.

(21) Appl. No.: 12/037,580

(22) Filed: Feb. 26, 2008

(65) Prior Publication Data

US 2008/0203198 A1 Aug. 28, 2008

Related U.S. Application Data

(63) Continuation-in-part of application No. 11/329,508, filed on Jan. 10, 2006, now Pat. No. 7,402,798.

(60) Provisional application No. 60/645,165, filed on Jan. 18, 2005.

(51) Int. Cl.
*H01J 49/10* (2006.01)
*H01J 49/00* (2006.01)

(52) U.S. Cl. ..... 250/288; 250/281; 250/282; 422/61; 422/62; 422/63

(58) Field of Classification Search ..... None
See application file for complete search history.

(56) References Cited

U.S. PATENT DOCUMENTS

| | | | | |
|---|---|---|---|---|
| 4,398,671 | A | 8/1983 | Coffee et al. | |
| 4,467,961 | A | 8/1984 | Coffee et al. | |
| 4,797,820 | A | 1/1989 | Wilson et al. | |
| 4,842,701 | A * | 6/1989 | Smith et al. | 204/451 |
| 5,218,305 | A | 6/1993 | Lunzer | |
| 5,349,186 | A | 9/1994 | Ikonomou et al. | |
| 5,489,929 | A | 2/1996 | Vago et al. | |
| 5,647,542 | A | 7/1997 | Diana | |
| 5,663,560 | A | 9/1997 | Sakairi et al. | |
| 5,917,184 | A | 6/1999 | Carson et al. | |
| 6,066,848 | A * | 5/2000 | Kassel et al. | 250/288 |
| 6,191,418 | B1 * | 2/2001 | Hindsgaul et al. | 250/288 |
| 6,207,954 | B1 * | 3/2001 | Andrien et al. | 250/288 |
| 6,326,062 | B1 | 12/2001 | Noakes et al. | |
| 6,326,616 | B1 * | 12/2001 | Andrien et al. | 250/288 |
| 6,573,494 | B1 * | 6/2003 | Andrien et al. | 250/288 |
| 6,627,166 | B1 | 9/2003 | Simon et al. | |
| 6,690,006 | B2 * | 2/2004 | Valaskovic | 250/288 |
| 6,831,274 | B2 * | 12/2004 | Smith et al. | 250/288 |
| 6,932,939 | B2 * | 8/2005 | Ozbal et al. | 422/63 |
| 7,193,124 | B2 | 3/2007 | Coffee et al. | |
| 7,402,798 | B2 * | 7/2008 | Staats | 250/288 |
| 7,641,242 | B2 * | 1/2010 | Van Pelt | 285/384 |
| 2003/0205631 | A1 | 11/2003 | Barron et al. | |
| 2008/0006769 | A1 * | 1/2008 | Staats | 250/288 |
| 2008/0203198 | A1 * | 8/2008 | Staats et al. | 239/690.1 |

* cited by examiner

*Primary Examiner*—David A Vanore
(74) *Attorney, Agent, or Firm*—Leason Ellis LLP

(57) ABSTRACT

A method for controlling an electrostatically induced liquid spray includes the steps of: (1) generating a liquid spray from a liquid sample with an electrostatic spray nozzle device using an applied electric field, wherein at least a nozzle portion of the spray device is formed of an insulating material; (2) sensing a current of the liquid spray with a spray current sensing means placed in relation to the spray device; (3) comparing the sensed current of the liquid spray with a preselected current value, with a difference between the two representing a control signal; and (4) varying the applied electric field using a computer-controlled positioning mechanism that moves the spray device relative to an inlet of the object that receives the liquid spray and acts as a counter-electrode.

26 Claims, 7 Drawing Sheets

APPARATUS AND METHOD FOR CONTROLLING AN ELECTROSTATICALLY INDUCED LIQUID SPRAY

CROSS-REFERENCE TO RELATED APPLICATION

The present application is a continuation in part to U.S. patent application Ser. No. 11/329,508, filed Jan. 10, 2006, which claims the benefit of U.S. patent application Ser. No. 60/645,165, filed Jan. 18, 2005, which are hereby incorporated by reference in their entireties.

TECHNICAL FIELD

The present application relates to an apparatus and methods that improve the performance of spraying a liquid through a nozzle opening solely by means of an electric field.

BACKGROUND

One type of liquid spraying is known as nano-electrospray or nanospray when used as a sample introduction method in mass spectrometry. The sources of generating such a spray may be quartz or glass capillaries tapered to a tip having a predetermined diameter, or they can be microfabricated nozzles made of silicon or other semiconductor or glass, etc. A liquid spraying apparatus can include the spray nozzle and a mechanism for pumping liquid through the nozzle, as well as a high voltage power supply for supplying the electric field for generating the spray.

SUMMARY

The sources of generating a liquid spray may be a quartz or glass capillaries tapered to a tip of a few microns to 10's of microns in diameter, microfabricated nozzles made of silicon or other semiconductor or glass, or injection-molded nozzles with a nozzle opening of ~20 microns. The apparatus consists of a spray nozzle and the mechanism for pumping liquid through the nozzle, a high voltage power supply for supplying the electric field for spraying, an electric current sensing means in the vicinity of the nozzle, and a negative feedback loop mechanism provided by an electronic circuit or a software program that inputs the current generated by the spray and outputs a signal to either the pumping mechanism or the voltage power supply to regulate the flow rate of the liquid sample or the electric field for spraying, respectively, according to a set level of current. With this apparatus, flow rate of the liquid sample from the nozzle opening can be accurately controlled.

Problems such as sample overshoot at the beginning of a spray, flow interruption due to extraneous factors such as air bubbles in the liquid sample, or surface tension changes due to changes in the chemical composition of the sample can be effectively eliminated. If an array of spraying nozzle is used, each spraying nozzle may be assigned a different set current according to the need of the experiment. Another important application of the invention is that the pumping speed of the sample liquid through the nozzle can be varied in a controlled fashion so that the pump speed can be substantially faster at the beginning when the sample liquid is going through the "dead volume" in the channel leading to the nozzle opening, thereby shortening the wait time between samples. This has particular utilization when the nozzles are in an array format and many samples are sprayed from individual nozzles sequentially.

The present invention relates to an apparatus and methods that improve the performance of spraying a liquid through a nozzle opening solely be means of an electrical field. Specifically, such a form of liquid spraying, is referred in the industry as nano-electrospray or nanospray when used as a sample introduction method in mass spectrometry. The sources of generating such a spray can be a quartz or glass capillaries tapered to a tip of a few microns to 10's of microns in diameter or the source can be microfabricated nozzles made of silicon or other semiconductor or glass, or the source can be in the form of injection-molded nozzles with a nozzle opening of about 20 microns. Injection-molded nozzles of this type are described in detail in U.S. Pat. Nos. 6,800,840 and 6,969,850, both of which are hereby incorporated by reference in their entirety.

The apparatus, according to one exemplary embodiment, corrects the intermittent spray deficiencies associated with prior art devices and ensures a continuous spray and therefore, continuous acquisition of data by varying the electric field felt by the liquid at the tip of the spray source.

The apparatus includes a spray nozzle and the mechanism for pumping liquid through the nozzle, a high voltage power supply for supplying the electric field for spraying, an electric current sensing means in the vicinity of the nozzle, and a computer controlled positioning mechanism to move the spray tip of the spray device toward or away from a mass spectrometer inlet. The apparatus also includes a negative feedback loop mechanism provided by an electronic circuit or a software program that inputs the current generated by the spray and outputs a signal to either the pumping mechanism or the electric field for spraying, respectively, according to a set level of current.

One exemplary method for varying the electric field according to the present invention is a computer-controlled positioning mechanism to move the spray tip of the spray device toward or away from the mass spectrometer inlet.

The electric field needed to generate a spray is typically made up of two components, namely, the electric field due to the applied high voltage V on the small radius R of the small spray tip, i.e., V/R, and the distance D between the spray tip and the counter-electrode, which is the mass spectrometer inlet, i.e., V/D. The detailed forms of these components of the electric field depend on the actual geometric shape and configuration of the spray tip, electrode, etc. Since the radius of the spray tip is typically in the micro-size range, and the distance D is typically on the mm length-scale, changing the distance D to vary the electric field has not been practical. However, with the plastic nozzle where the radius of the nozzle tip does not directly enter into the electric field equation because it is insulating, adjusting D becomes a very effective means for changing the electric field quickly to induce spray. For metallic or silica spray devices, the distance D typically becomes very small (on the order of the size of the radii of the device tips) before the changed electric field will have an effect on the spray performance of the device. Changing the applied high voltage to change the electric field is not practical because the high voltage power supply typically has a large time constant so that the change in voltages is too slow to respond to the change in the spray conditions.

BRIEF DESCRIPTION OF THE DRAWING FIGURES

The present invention will be understood and appreciated more fully from the following detailed description of preferred embodiments of the present invention, taken in conjunction with the following drawings in which.

DESCRIPTION OF PREFERRED EMBODIMENTS

Figure 1:
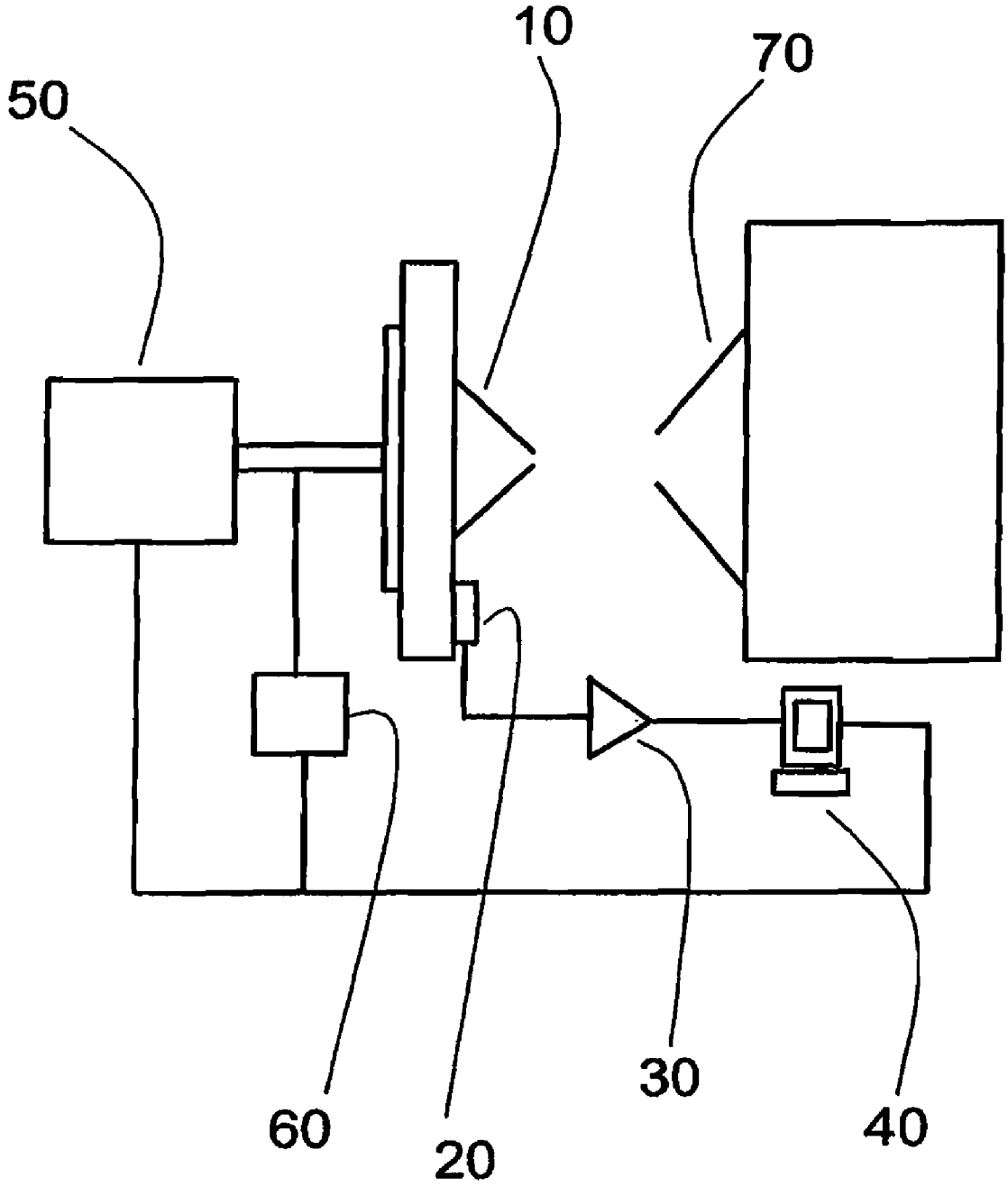
FIG. 1 is a schematic view of an apparatus for spray control according to a first embodiment, with a current sensing element disposed behind but in the vicinity of a spray nozzle device.

Referring to FIG. 1, the present invention consists of an electrostatic spray device 10 (e.g., a spray nozzle), a spray current sensing means, 20, which is placed in the vicinity of the spray device 10 and is connected to a current amplifier 30 and a negative feedback mechanism 40. The negative feedback mechanism 40 is configured to take the output from the spray current sensing means 20 and compares it to a pre-set reading of the current. The difference of the two is sent as a signal to regulate a pumping mechanism 50 (pump) or a programmable voltage power supply 60. The so regulated spray is input into the mass spectrometer inlet 70 that is disposed in an axial relationship with respect to the spray device 10 as shown. In other words, the openings of the spray nozzle 10 and the mass spectrometer inlet 70 are axially aligned with respect to one another.

In one embodiment, as exemplified in FIG. 1, the current sensing means 20 can be an electrode placed close to but behind the opening of the nozzle (spray device 10). In another embodiment, the sensing device 20 is an electrical conducting element placed from a millimeter to up to several cm in front of the spray nozzle device 10. The requirement on the design of the current sensing element 20 is that it does not physically obstruct the spray discharged from device 10 from entering the mass spectrometer inlet 70.

Figure 2:
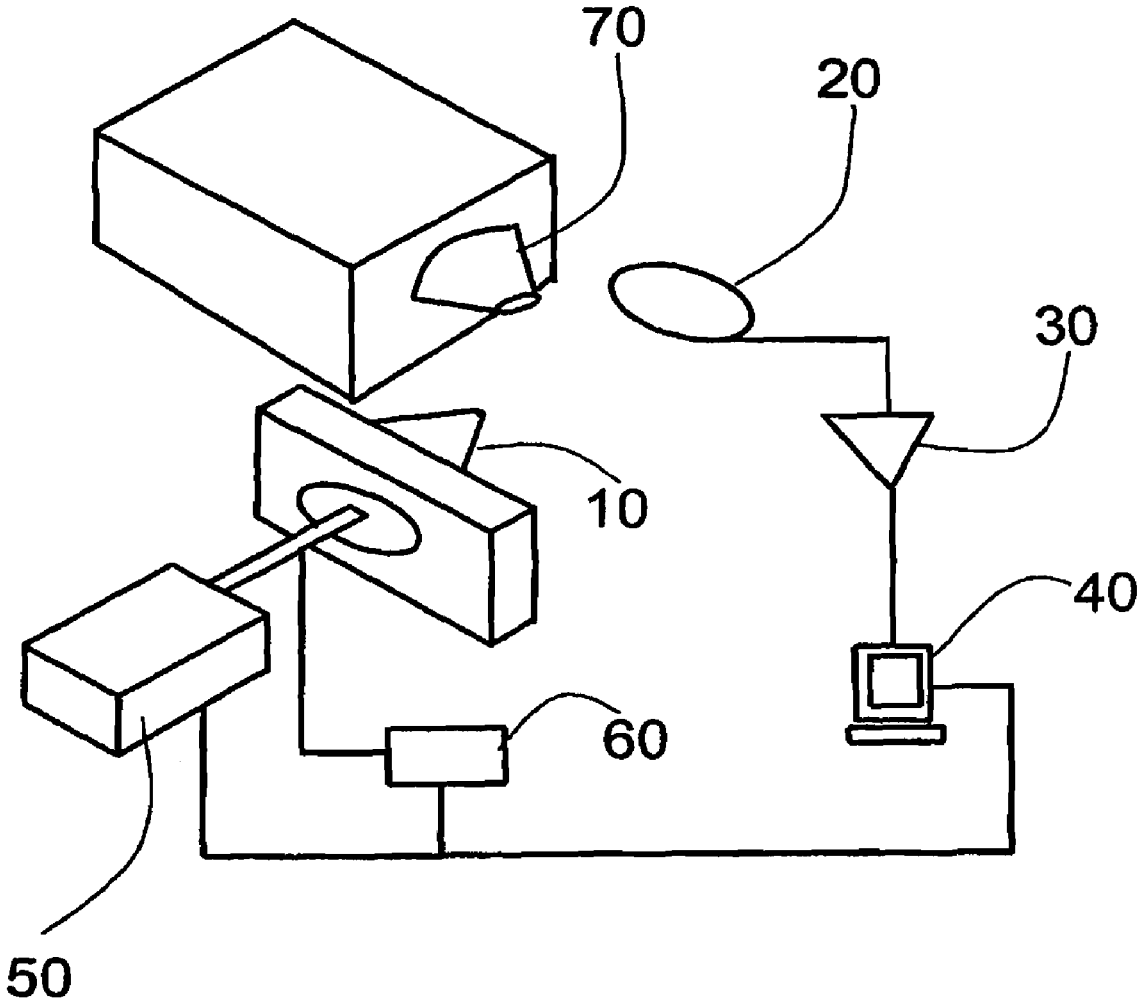
FIG. 2 is a schematic view of an apparatus for spray control according to a second embodiment, with a current sensing element disposed in front of a spray nozzle device that is placed perpendicular to a mass spectrometer inlet.

In FIG. 2, the spray nozzle 10 is positioned perpendicular to the inlet 70 of the mass spectrometer and the current sensing device 20 is placed directly in front of the nozzle 10 and beyond the mass spectrometer inlet 70 so as not to interfere with the reception of the spray in the inlet 70.

Figure 3:
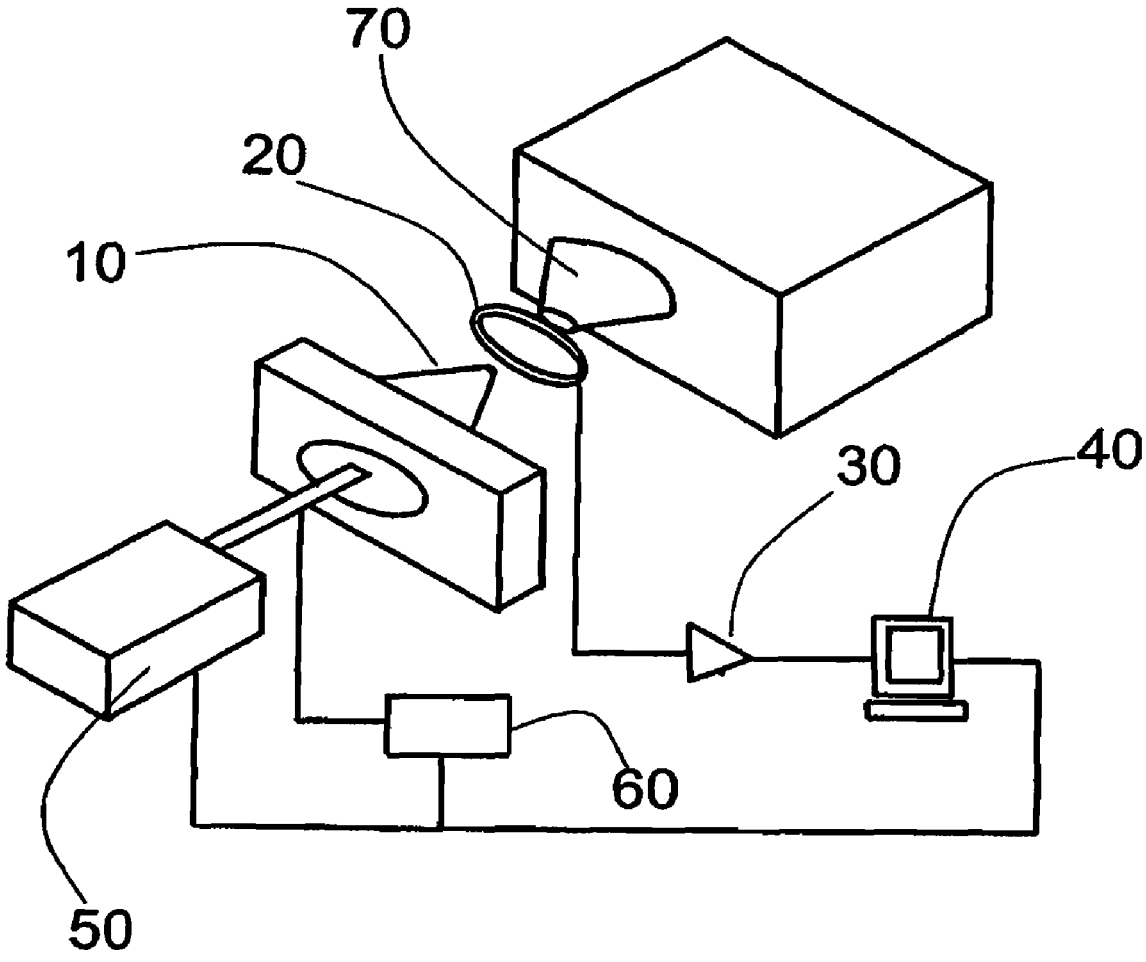
FIG. 3 is a schematic view of an apparatus for spray control according to a third embodiment, with a current sensing element disposed between a spray nozzle device and a mass spectrometer inlet.

In FIG. 3, the current sensing device 20 is placed between the spray nozzle 10 and the mass spectrometer inlet 70, and the current device 20 has an orifice that allows the spray to enter the mass spectrometer inlet 70 without physical obstruction.

Figure 4:
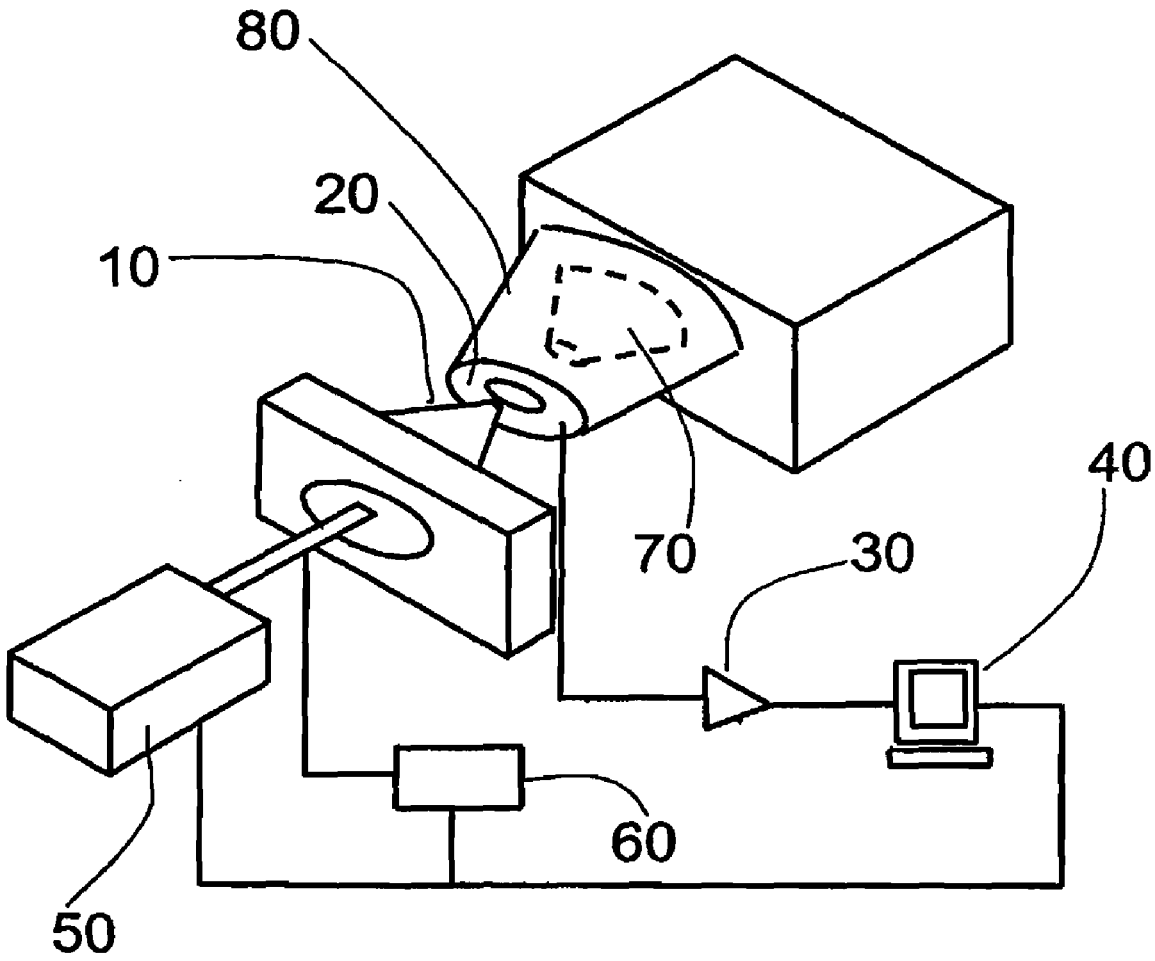
FIG. 4 is a schematic view of an apparatus for spray control according to a fourth embodiment, with a current sensing element enclosing a mass spectrometer inlet.
Figure 5:
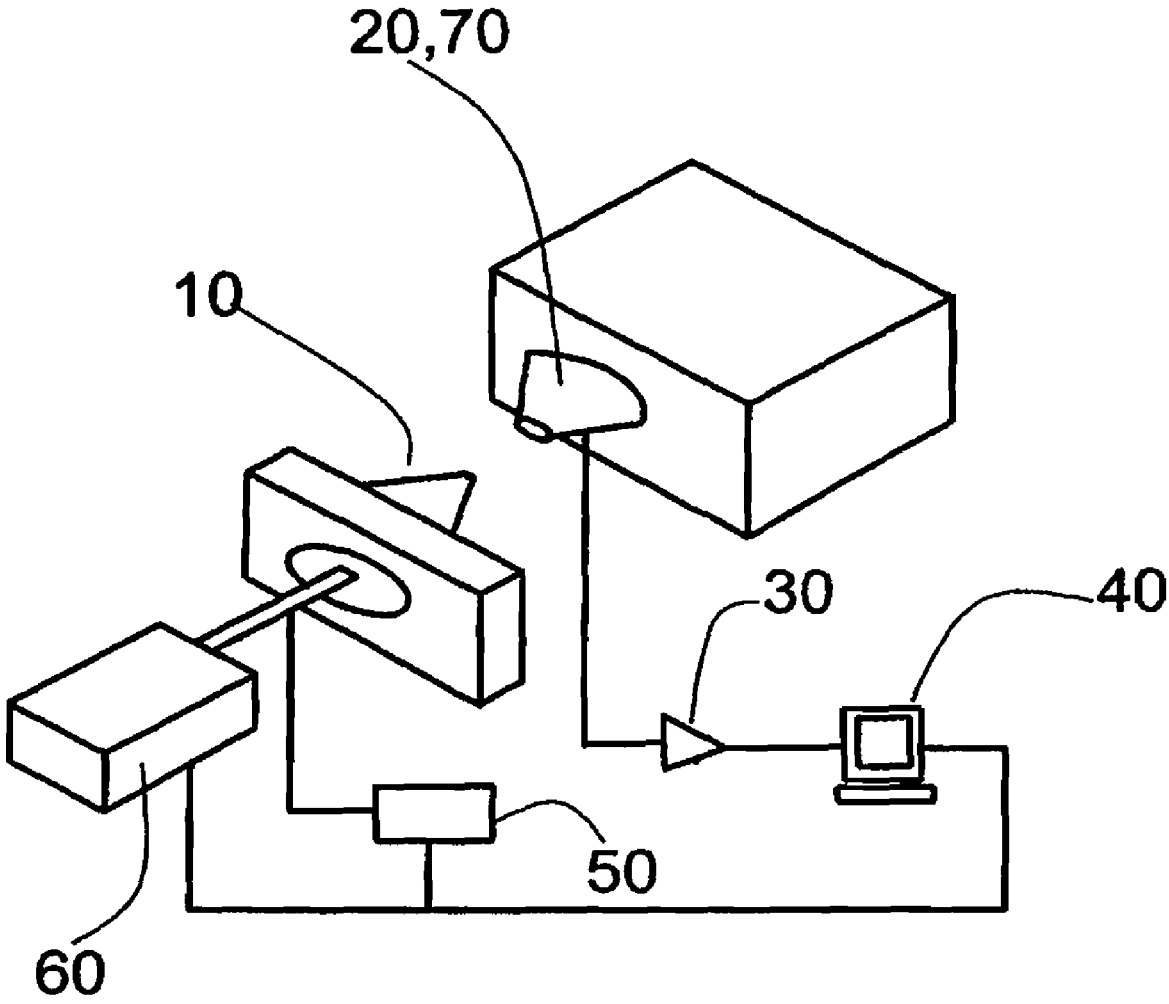
FIG. 5 is side schematic view of an apparatus for spray control according to a fifth embodiment, with a current sensing element incorporated into the design of a mass spectrometer inlet.

In yet another embodiment of the invention, the current sensing device 20 is a part of an enclosure 80 that surrounds the mass spectrometer inlet 70 but is electrically isolated from the mass spectrometer inlet 70, as schematically depicted in FIG. 4. The enclosure 80 acts as an electrical lens that focuses the spray from the nozzle 10 into the mass spectrometer inlet 70. In still another embodiment, the current sensing device 20 can be a part of the mass spectrometer inlet 70 as shown in FIG. 5.

To use the apparatus to regulate a spray, a liquid sample typically consists of a volatile organic liquid and water stored in a reservoir which may or may not be attached to the spraying nozzle, is pumped by means of an air or hydraulic pressure through the nozzle opening which is typically from a few microns to over 20 microns in diameter while a high voltage from abut 1 KV to several KV is applied to the nozzle tip or the liquid sample. A conical spray of the liquid sample into a fine mist results beyond the nozzle opening. Such a spray consists of many electrically charged droplets and ions, which when collected by the current sensing element, and input into a current amplifier, forms a measurable current typically from a few nanoamperes to 10's of microamperes, depending on the concentration of charged particles in the liquid sample, the ionization efficiency of the liquid sample under the electric field at the nozzle, the flow rate of the sample liquid through the nozzle, and the applied high voltage.

The dependence of the current over certain ranges of flow rates and applied voltage may be assumed to be more or less linear. Within these ranges where the dependence appears to be linear, the collected current is fairly stable at any fixed flow rate and applied voltage for a given liquid sample and nozzle geometry. When this current is larger in magnitude than that of a set reference current, the difference of the measured current and the set reference current creates a signal to the controller of the pump pumping the sample liquid through the nozzle to slow down or even reverse the pump direction. This change in the pumping action will reduce the flow rate of the liquid sample through the nozzle and thus make the spray current smaller, which when collected by the current sensing element and compared to the set reference current, will send an appropriate signal to control the pump action so that the effect of the regulation over a period of time is a constant spray current. Likewise the control signal may be sent to a programmable power supply that supplies the voltage for generating and maintaining the spray. The details of this close-loop negative feedback control mechanism is well known in the art, and can be implemented with a electronic circuit including a comparator, a signal integrator with a time constant element, or if the time constant is relatively large, directly with a computer with a analog to digital (A/D) input and digital to analog (D/A) output and appropriate software providing the functions of a comparator/integrator circuit.

The amplitude of the spray current is dependent on the liquid sample being sprayed. Samples containing a large quantity of ionizable molecules give a much larger spray current at the same pump rate and applied voltage than samples containing very few such molecules, such as the sample buffers. The reference current used to control the spray must be set according to the samples being sprayed.

Figure 6:
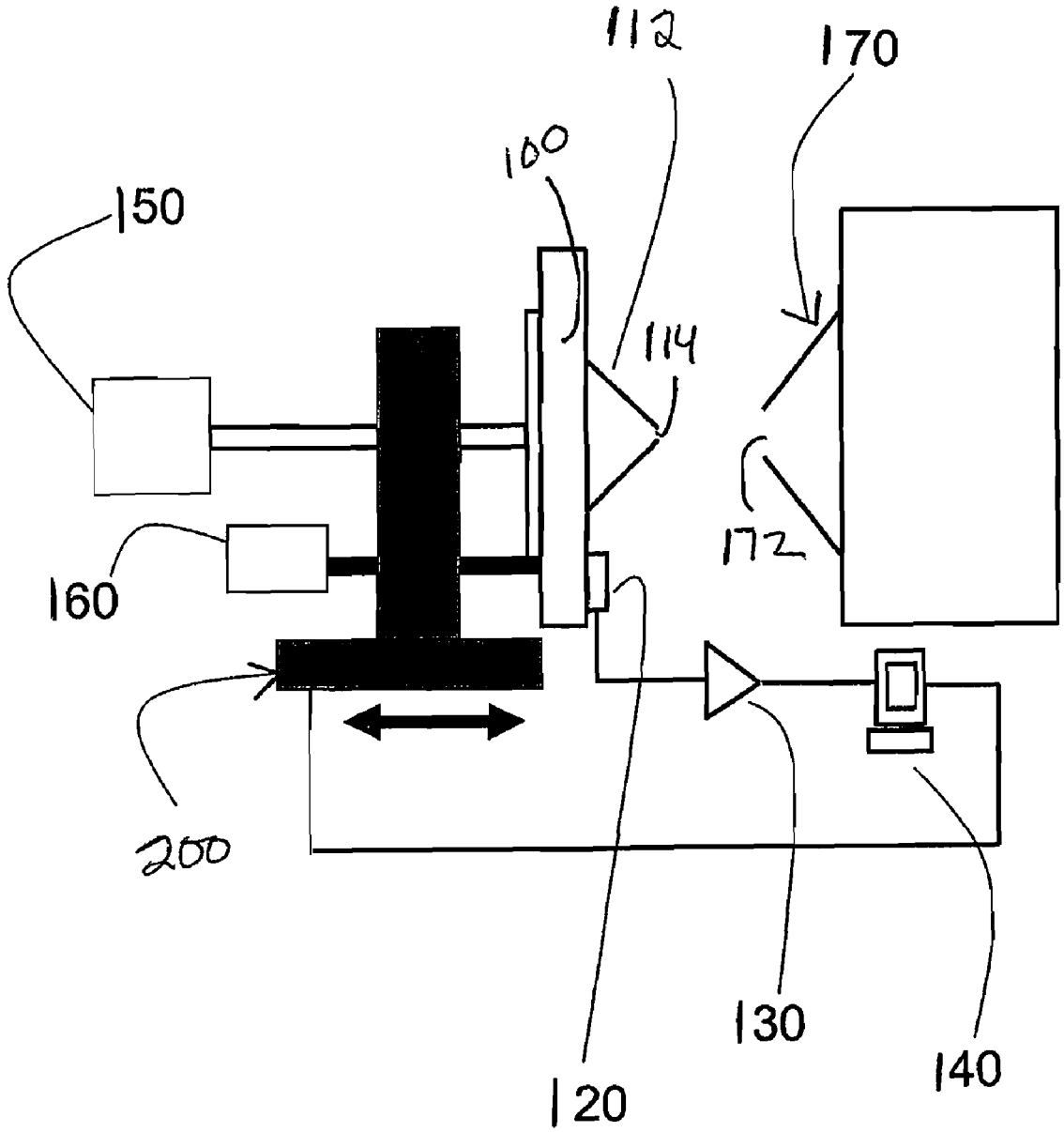
FIG. 6 is a side elevation view of an electrostatic spray system according to a first exemplary embodiment with a spray nozzle thereof being located directly in front of a mass spectrometer inlet.

Referring to FIG. 6, the present invention according to a first embodiment is in the form of an electrostatic spray assembly that includes an electrostatic spray device 100 (e.g., a spray nozzle), a spray current sensing means, 120, which is placed in the vicinity of the spray device 100 and is connected to a current amplifier 130 and a negative feedback mechanism 140. The negative feedback mechanism 140 is configured to take the output from the spray current sensing means 120 and compares it to a pre-set reading of the current. The difference of the two is sent as a signal to regulate a pumping mechanism 150 (pump) or a programmable voltage power supply 160.

The spray device 100 can be any number of different devices as discussed above and in the illustrated embodiment, the device 100 is in the form of a device that has a nozzle 112 that includes a tip that defines a small opening 114 through which the spray is discharged.

The system also includes a positioning mechanism 200 that carries the device 100, the pumping mechanism 150 and the power supply 160. More specifically, the positioning mechanism 100 is configured so that it can controllably move the device 100, mechanism 150 and power supply 160 in one or more directions and for a prescribed increment or distance. The positioning mechanism 200 can be any number of different types of programmable mechanical positioning devices that are in communication with an operating system, such as a computer, and are operated, in particular, to move the device 100 relative to another object. The positioning mechanism 200 thus moves the device 100 either closer or further away from another target object as will be described in more detail below.

The spray generated by the device 100 that is discharged through the opening 114 is directed toward or injected into some other object which typically is the same object that the positioning device moves the device 100, and in particular, the nozzle 112 thereof, relative to an object. In one embodiment, the object is a mass spectrometer 170 that has an inlet 172 into which the spray from device 100 is received.

The so regulated spray is input into the mass spectrometer inlet 172 that is disposed, in this embodiment, in an axial relationship with respect to the spray device 100 as shown in FIG. 6. In other words, the nozzle opening 14 of the spray nozzle device 100 and the mass spectrometer inlet 172 are axially aligned with respect to one another.

In one embodiment as exemplified in FIG. 6, when the current sensing means 120 detects a current smaller than the set current, the negative feedback mechanism 140 sends a signal through the computer to the positioning mechanism 100 to move the nozzle 112 of the spray device 100 toward the mass spectrometer inlet 172, thereby making the electric field felt by the liquid at the tip 114 of the spray device 100 become stronger.

Once the spray discharged from the device 100 generates a current larger than the set current as measured by the current sensing means 120, the feedback mechanism 140 sends a signal via the computer to increase the distance between the spray device 100 and the mass spectrometer inlet 172, thereby reducing the electric field felt by the liquid sample at the tip of the spray device 100, which in turn reduces the spray current.

Figure 7:
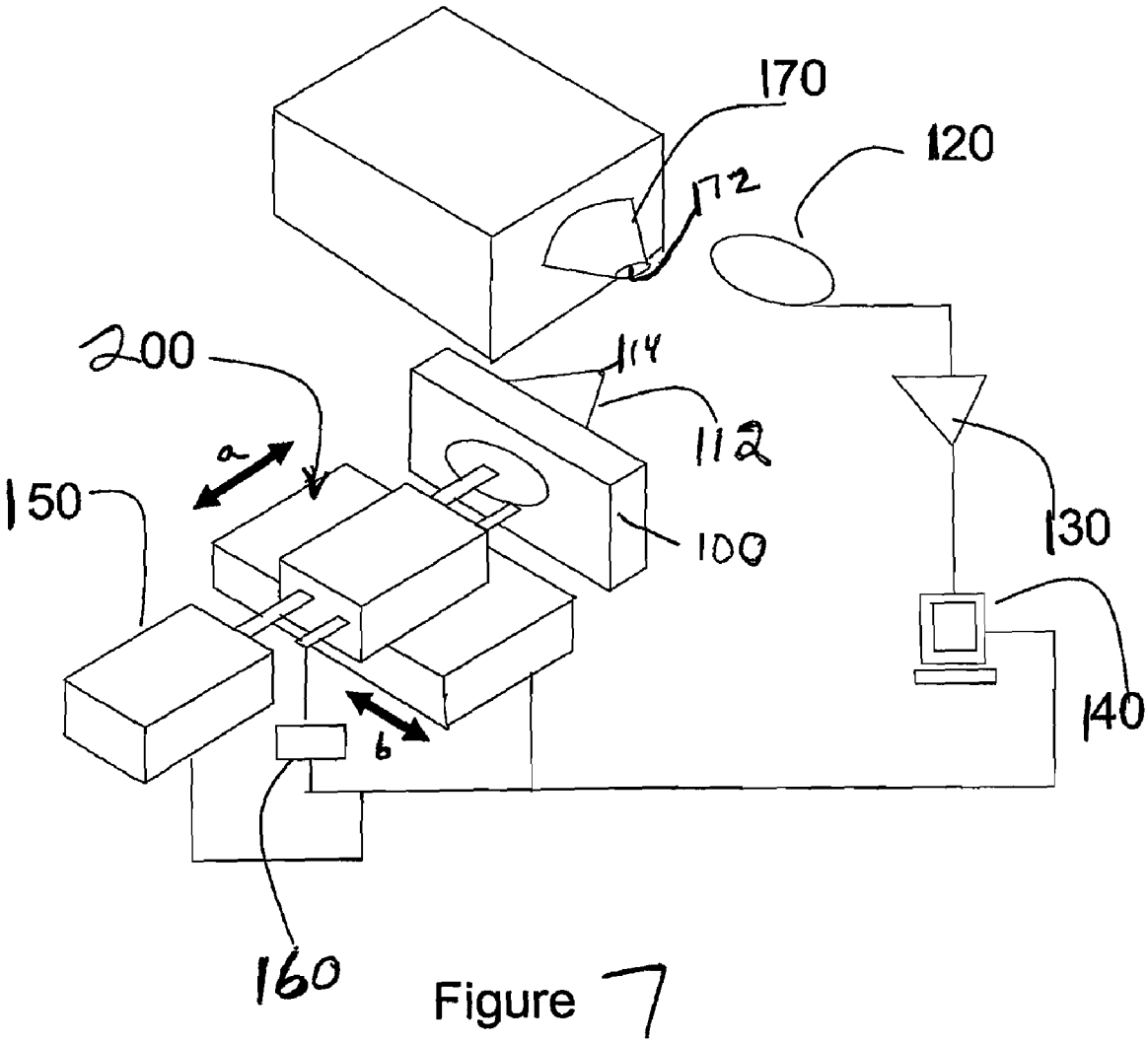
FIG. 7 is a perspective view of an electrostatic spray system according to a second exemplary embodiment with the spray nozzle thereof being located perpendicular to the mass spectrometer inlet.

Now turning to FIG. 7 in which another embodiment of the present invention is shown. In this embodiment, the spray nozzle device 100 is positioned perpendicular to the inlet 172 of the mass spectrometer 170. In addition, the positioning mechanism 200 can be configured to move the device 100 in at least two directions and in particular, the positioning mechanism 200 can move the device 100 in two directions that are perpendicular to one another. In FIG. 7, the positioning mechanism 200 moves in a first direction "a" and in a second direction "b" that is perpendicular to the "a" direction.

By allowing the positioning mechanism 200 to move in two directions, the nozzle 112 of the spray device 100 can be placed at an optimal position to attain the best electric field for spraying.

It will also be appreciated that the positioning mechanism 200 can be configured to move in three directions (three axes of motion, such as x, y, and z directions). This permits even greater control over the position of the device 100 relative to the target object, in this case the inlet 172. However, in general, no more than two axes of motion are needed. The positioning mechanism 200 can consist of motorized linear motion stages or rotary motion stages.

To use the apparatus of the present invention to regulate a spray, a liquid sample typically consists of a mixture of volatile organic liquid and water is connected to the spray nozzle 112 of the device 100 and is then pumped by means of air pressure or hydraulic pressure through the nozzle opening 114 which is typically from a few microns to over 20 microns in diameter, while a high voltage from about 1 KV to several KV is applied to the nozzle tip 114 or the liquid sample. A conical spray of the liquid sample results in a fine mist being formed beyond the nozzle opening 114. This spray consists of many electrically charged droplets and ions, which when collected by the current sensing element 120 and input into the current amplifier 130, forms a measurable current typically from a few nanoamperes to 10's of microamperes, depending on a number of parameters, including but not limited to, the concentration of the charged particles in the liquid sample, the ionization efficiency of the liquid sample under the electric field at the nozzle 112, the flow rate of the sample liquid through the nozzle 112, and the applied high voltage.

When this measurable current is greater in magnitude than that of a set reference current (threshold value), the difference of the measured current and the set reference current is creates a signal to the controller of the positioning mechanism 200 to move the nozzle 112 away from the mass spectrometer inlet 172. This change in the nozzle position will reduce the electric field for the spray and thus, make the spray current smaller. When the current sensing element 120 collects the smaller spray current and compares it to the set reference current, the element 120 sends an appropriate signal to control the positioning mechanism 200 so that the effect of the regulation over a period of time is a constant spray current.

The amplitude of the spray current is dependent on the liquid sample being sprayed. Samples containing a larger quantity of ionizable molecules give a much larger spray current at the same pump rate and applied electric field compared to samples containing very few such molecules, such as the sample buffers. Samples containing a varying composition of mixtures as is commonly the case in reverse phase liquid chromatography will also generate currents of different magnitudes for a given pump rate and applied electric field. The reference current used to control the spray must be set according to the sample being sprayed.

It will also be appreciated that the components or arrangements of the devices set forth in the embodiments of FIGS. 1-5 can be combined and employed in the arrangements shown in FIGS. 6-7. For example, two or more embodiments can be combined into a single embodiment (e.g., the spray device and electronic components and mass spectrometer arrangement of FIG. 3, 4 or 5 with the positioning mechanism 200 shown in FIG. 6 or 7).

While the invention has been particularly shown and described shown and described with reference to preferred embodiments thereof, it will be understood by those skilled in the art that various changes in form and details may be made therein without departing from the spirit and scope of the invention.

What is claimed is:

1. A system for controlling an electrostatically induced liquid spray comprising:

an electrostatic spray device for generating a liquid spray from a liquid sample;

a spray current sensing means placed in relation to the spray device and configured to generate a current output signal that represents a current of the liquid spray; and a first mechanism that receives the current output signal and compares it to a pre-selected current value, with a difference between the two representing a control signal; and a movable positioning mechanism that is in communication with the first mechanism and receives the control signal, the spray device being coupled to the positioning mechanism so that movement of the positioning mechanism is directly translated into movement of the spray device in at least one direction for positioning the spray device relative to an object based on the difference between the current output signal and the pre-selected current value.

2. The system of claim 1, wherein the electrostatic spray device includes an injection-molded nozzle with an opening of about 20 microns through which the liquid spray is discharged.

3. The system of claim 1, wherein the electrostatic spray device includes a microfabricated nozzle through which the liquid spray is discharged.

4. The system of claim 1, wherein the electrostatic spray device comprises one of an electrode and an electrical conducting element.

5. The system of claim 1, wherein the current sensing means comprises one of an electrode disposed proximate but behind a nozzle opening of the spray device and an electrical conducting element placed in front of the spray device.

6. The system of claim 1, wherein the current sensing means is disposed proximate but behind an opening of the spray device through which the liquid spray is discharged.

7. The system of claim 1, wherein the object includes an inlet that receives the liquid spray, wherein the current sensing means is disposed in front of an opening of the spray device through which the liquid spray is discharged, the opening of the spray device and the inlet lying along the same linear axis.

8. The system of claim 7, wherein the object comprises a mass spectrometer.

9. The system of claim 1, wherein the object includes an inlet that receives the liquid spray, wherein the current sensing means is disposed in front of an opening of the spray device through which the liquid spray is discharged, the opening of the spray device being oriented perpendicular to the inlet.

10. The system of claim 1, wherein the object comprises a mass spectrometer having an inlet for receiving the liquid spray, the current sensing means enclosing the inlet and further acting as an electrostatic lens.

11. The system of claim 1, wherein the object comprises a mass spectrometer having an inlet for receiving the liquid spray, the current sensing means being formed as part of the inlet.

12. The system of claim 1, wherein the first mechanism includes a current amplifier and a negative feedback element for receiving the current output signal and comparing it to the pre-selected current value for generating the output signal.

13. The system of claim 1, wherein the control signal is also sent to one of (1) a pump that regulates the flow rate of the liquid sample and (2) a power supply to regulate an electric field associated with the spray device that generates the liquid spray according to a set level of current.

14. The system of claim 1, wherein the positioning mechanism is configured to move in motorized linear motion stages or rotary motion stages.

15. The system of claim 1, wherein if the first mechanism detects that that the spray is generating a current output signal that is less than the pre-selected current value which represents a threshold value, a control signal is generated instructing the positioning mechanism to move the spray device more towards the object causing an electric field applied to the liquid sample at a tip of the spray device to become stronger.

16. The system of claim 15, wherein as the positioning mechanism moves the spray device towards the object, the current of the liquid spray that is sensed by the current sensing means becomes greater, the spray device being moved towards the object until the current output signal is substantially the same as the pre-selected current value at which time the positioning mechanism stops moving the spray device.

17. The system of claim 16, wherein as the positioning mechanism moves the spray device away from the object, the current of the liquid spray that is sensed by the current sensing means becomes less, the spray device being moved away from the object until the current output signal is substantially the same as the pre-selected current value at which time the positioning mechanism stops moving the spray device.

18. The system of claim 1, wherein if the first mechanism detects that that the spray is generating a current output signal that is greater than the pre-selected current value which represents a threshold value, a control signal is generated instructing the positioning mechanism to move the spray device away from the object causing an electric field applied to the liquid sample at a tip of the spray device to become weaker.

19. The system of claim 1, wherein the positioning device is configured to move the spray device in at least two directions which are perpendicular to one another.

20. The system of claim 1, wherein the positioning mechanism is in communication with the negative feedback element for receiving control signals that are translated into movement of the positioning mechanism.

21. A method for controlling an electrostatically induced liquid spray comprising the steps of:

generating a liquid spray from a liquid sample with an electrostatic spray nozzle device using an applied electric field, wherein at least a nozzle portion of the spray device is formed of an insulating material;

sensing a current of the liquid spray with a spray current sensing means placed in relation to the spray device;

comparing the sensed current of the liquid spray with a pre-selected current value, with a difference between the two representing a control signal; and varying the applied electric field using a computer-controlled positioning mechanism that moves the spray device relative to an inlet of the object that receives the liquid spray and acts as a counter-electrode.

22. The method of claim 21, wherein the control signal is delivered to the positioning mechanism that carries the spray device and positions the spray device relative to the object based on the difference between the sensed current and the pre-selected current value.

23. The method of claim 21, further including the steps of:

moving the spray device closer towards the object when the sensed current is less than the pre-selected current value, which represents a threshold value, to cause the electric field applied to the liquid sample at a tip of the spray device to become stronger and the sensed current of the liquid spray to become greater, the spray device being moved towards the object until the current output signal is substantially the same as the pre-selected current value.

24. The method of claim 21, further including the steps of:

moving the spray device closer away from the object when the sensed current is greater than the pre-selected current value, which represents a threshold value, to cause the electric field applied to the liquid sample at a tip of the spray device to become weaker and the sensed current of the liquid spray to become less, the spray device being moved away from the object until the current output signal is substantially the same as the pre-selected current value.

25. The method of claim 21, wherein the nozzle of the spray device comprises an injection-molded article with an opening of about 20 microns through which the liquid spray is discharged.

26. A method for controlling an electrostatically induced liquid spray comprising the steps of:

generating a liquid spray from a liquid sample with an electrostatic spray device;

sensing a current of the liquid spray with a spray current sensing means placed in relation to the spray device comparing the sensed current of the liquid spray with a pre-selected current value, with a difference between the two representing a control signal; and delivering the control signal to a positioning mechanism that carries the spray device and positions the spray device relative to another object that receives the liquid spray based on the difference between the sensed current and the pre-selected current value.

* * * * *